US006659021B2

(12) United States Patent
Wen

(10) Patent No.: US 6,659,021 B2
(45) Date of Patent: Dec. 9, 2003

(54) FOLDABLE TABLE

(76) Inventor: Yung-Zhang Wen, 3, Shang Yi Cun, Da Bei Xiang, Yun Lin Hsien (TW)

( * ) Notice: Subject to any disclaimer, the term of this patent is extended or adjusted under 35 U.S.C. 154(b) by 64 days.

(21) Appl. No.: 10/099,019

(22) Filed: Mar. 13, 2002

(65) Prior Publication Data

US 2003/0172855 A1 Sep. 18, 2003

(51) Int. Cl.[7] ..... A47B 3/00
(52) U.S. Cl. ..... 108/125; 108/157.1
(58) Field of Search ..... 108/125, 129, 108/131, 132, 133, 901, 127, 157.1, 157.16; 248/188

(56) References Cited

U.S. PATENT DOCUMENTS 3,044,840 A * 7/1962 Hamilton ..... 108/125
5,934,204 A * 8/1999 Oberle ..... 108/157.1
6,112,674 A * 9/2000 Stanford ..... 108/132
6,371,034 B1 * 4/2002 Simpson et al. ..... 108/129
6,520,094 B2 * 2/2003 Wen ..... 108/132

* cited by examiner

*Primary Examiner*—Lanna Mai
*Assistant Examiner*—John Fitzgerald
(74) *Attorney, Agent, or Firm*—Alan Kamrath; Rider Bennett, LLP

(57) ABSTRACT

A foldable table has a plastics table plate, a hoop-shaped frame, four corner seats disposed on four corners of the hoop-shaped frame, and four leg tubes. Each leg tube is disposed on the corresponding corner seat. A center panel is disposed on the plastics table plate. The plastics table plate has a periphery flange and a periphery channel. Four square blocks are disposed on four corners of the plastics table plate. Each corner seat has a groove and an elastic blocking angle bar. At least a connection bar is connected to the corresponding corner seat and the corresponding leg tube. At least a connection plate is connected to the corresponding elastic blocking angle bar and the corresponding leg tube. The hoop-shaped frame is inserted in the plastics table plate. Each square block is inserted in the corresponding groove of the corner seat.

1 Claim, 7 Drawing Sheets

FOLDABLE TABLE

BACKGROUND OF THE INVENTION

The present invention relates to a foldable table. More particularly, the present invention relates to a foldable table which has a plastics table plate made by a blow molding method.

A conventional foldable table is very heavy. Thus it is difficult to carry the conventional foldable table to walk a long distance for a user.

SUMMARY OF THE INVENTION

An object of the present invention is to provide a foldable table which has a plastics table plate to receive four leg tubes so that the foldable table will be in a compact configuration while the leg tubes are folded.

Another object of the present invention is to provide a foldable table which has a plastics table plate made by a blow molding method in order to reduce a weight of the plastics table plate.

Accordingly, a foldable table comprises a plastics table plate, a hoop-shaped frame, four corner seats disposed on four corners of the hoop-shaped frame, four leg tubes, and a plurality of fastening members. Each of the leg tubes is disposed on the corresponding corner seat. A center panel is disposed on the plastics table plate. The plastics table plate has a periphery flange and a periphery channel. Four protrusions are disposed on the center panel. Four protruded blocks are disposed on the plastics table plate. Four square blocks are disposed on four corners of the plastics table plate. A plurality of nuts are implanted in the periphery channel of the plastics table plate. The hoop-shaped frame has a plurality of through holes. Each of the corner seats has a groove and an elastic blocking angle bar. At least a connection bar is connected to the corresponding corner seat and the corresponding leg tube pivotally. At least a connection plate is connected to the corresponding elastic blocking angle bar and the corresponding leg tube pivotally. The hoop-shaped frame is inserted in the plastics table plate and confined by the periphery flange of the plastics table plate. Each of the square blocks is inserted in the corresponding groove of the corner seat.

DETAILED DESCRIPTION OF THE INVENTION

Figure 1:
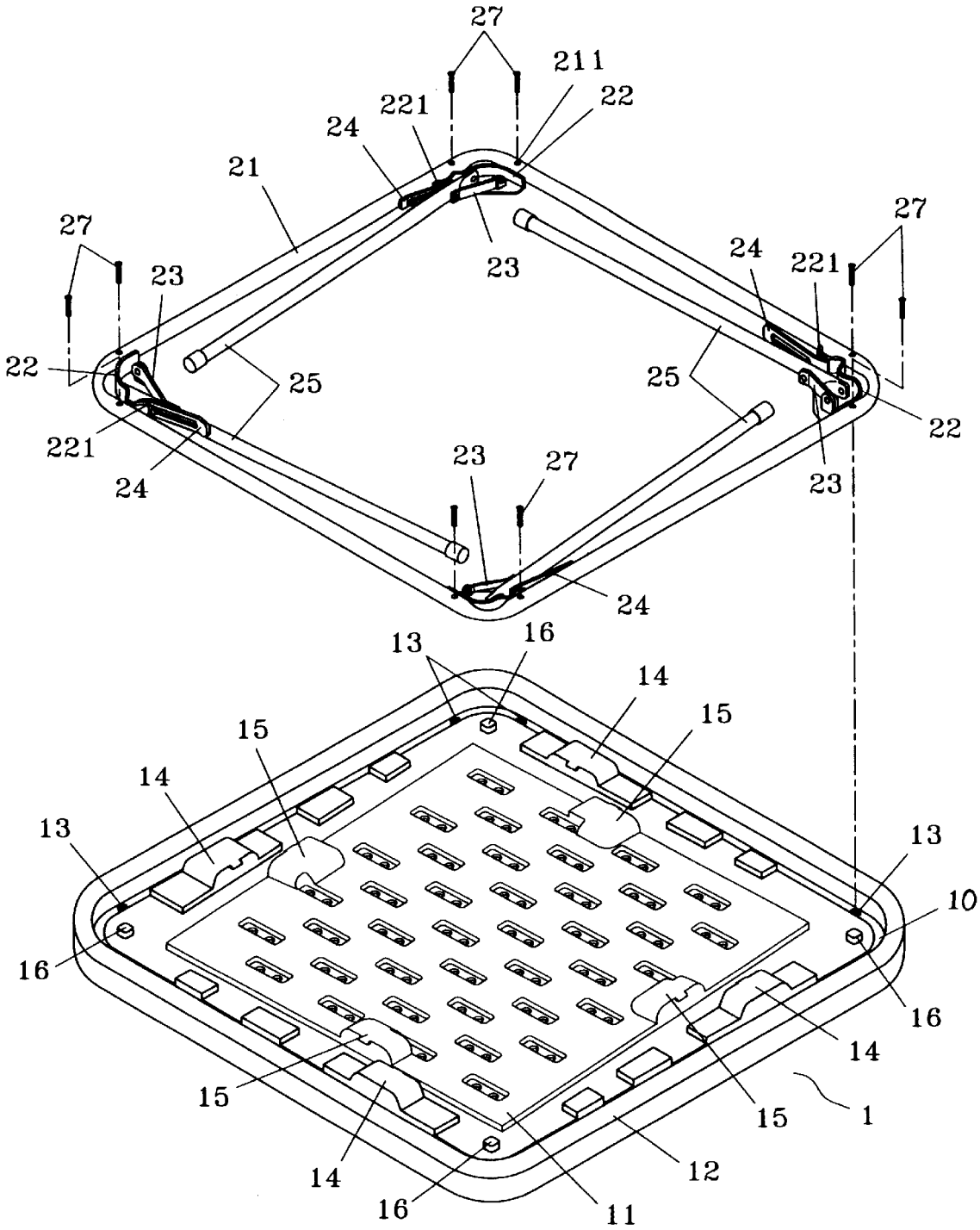
FIG. 1 a perspective exploded view of a foldable table of a preferred embodiment in accordance with the present invention.
Figure 2:
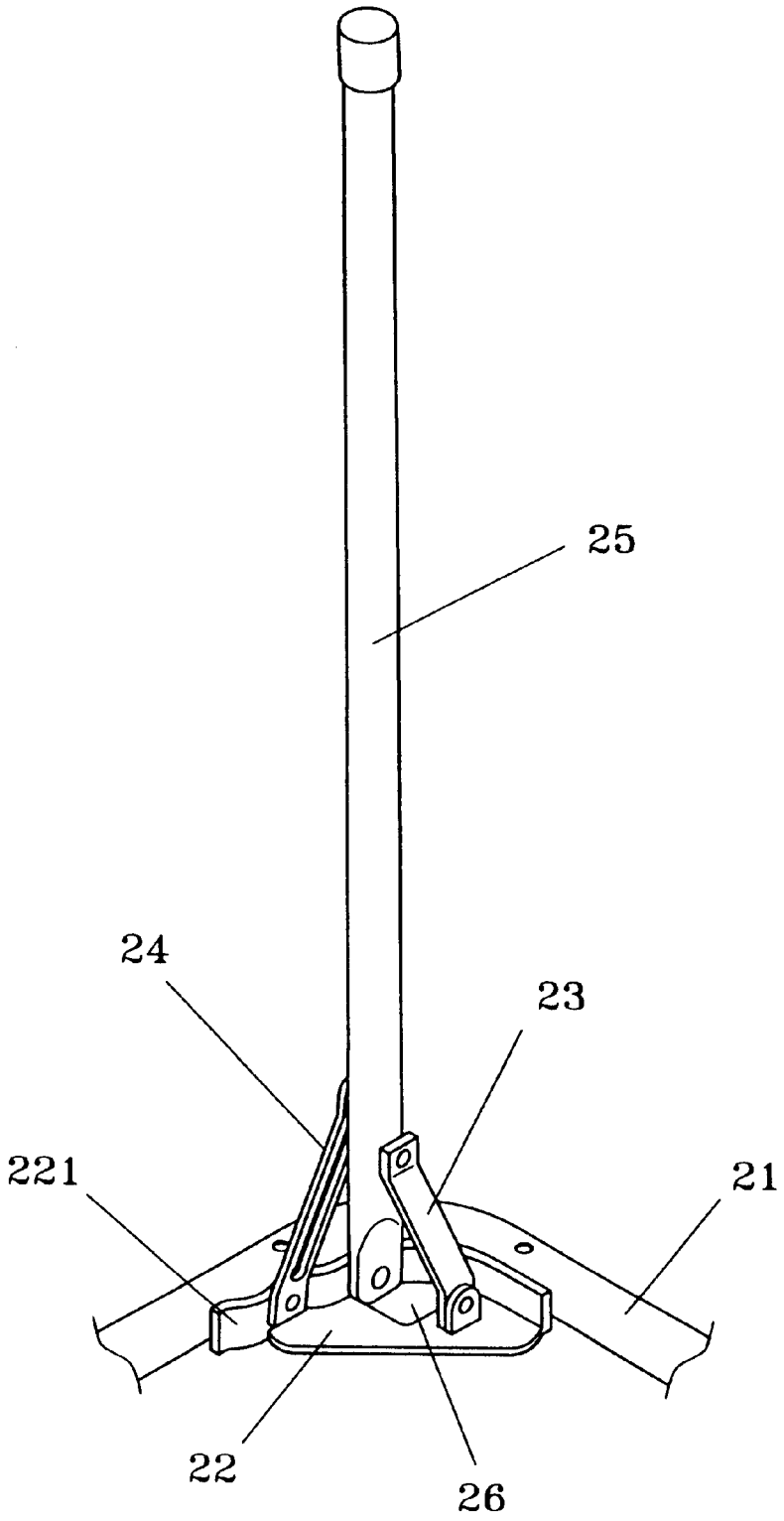
FIG. 2 is a perspective view of a hoop-shaped frame, a corner connector, and a leg tube of a preferred embodiment in accordance with the present invention.
Figure 3:
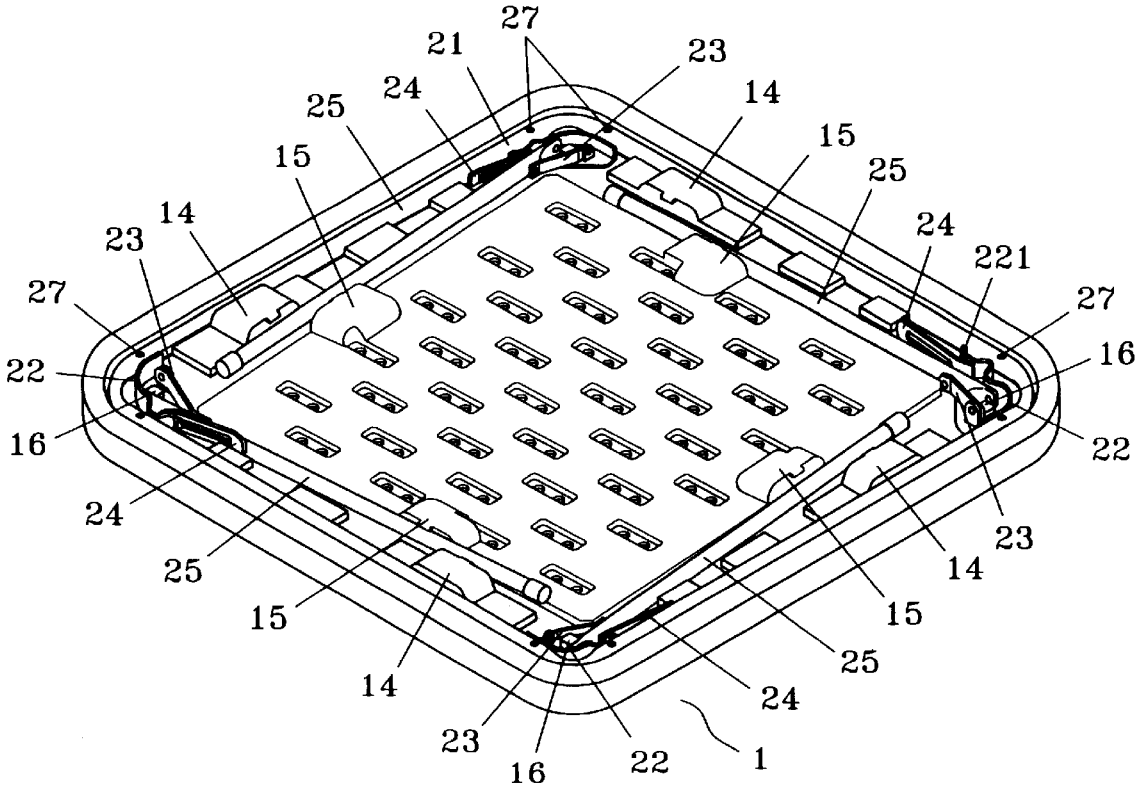
FIG. 3 is a schematic view illustrating four leg tubes of a preferred embodiment are folded.
Figure 4:
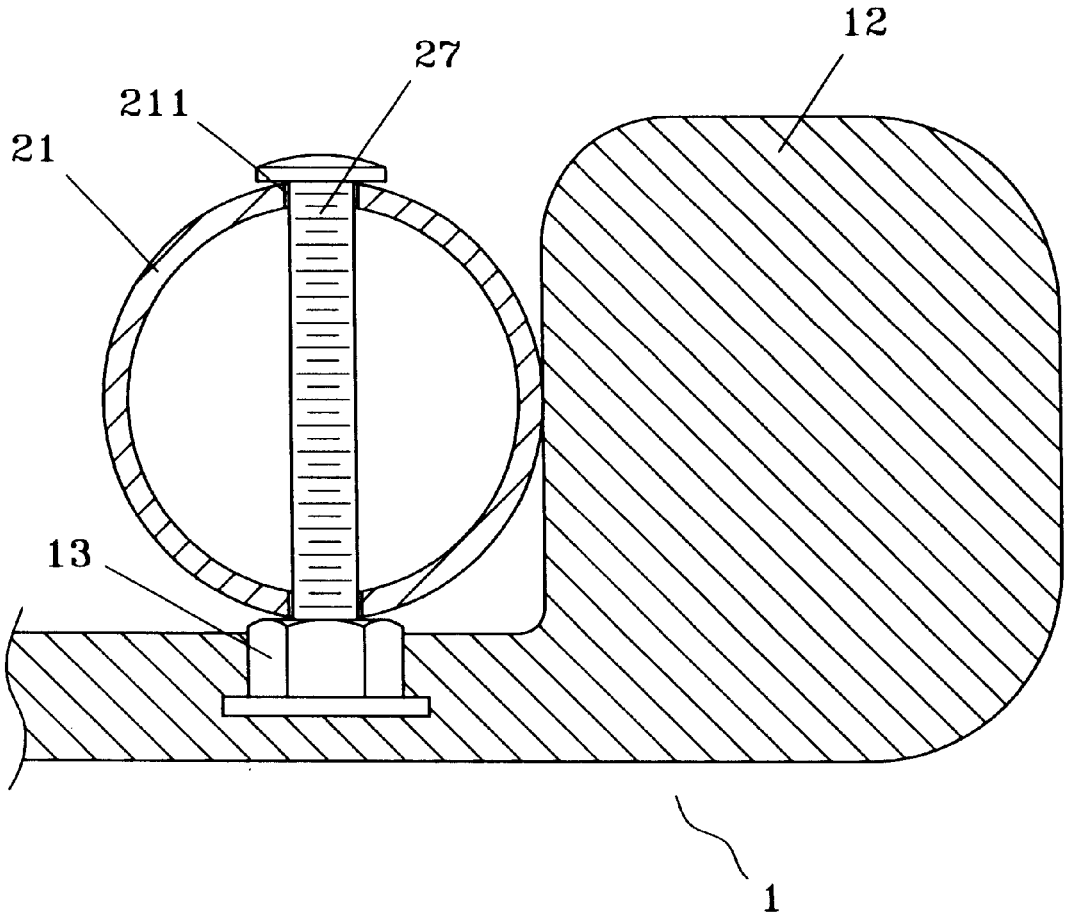
FIG. 4 is a sectional assembly view of a plastics table plate and a hoop-shaped frame of a preferred embodiment in accordance with the present invention.
Figure 5:
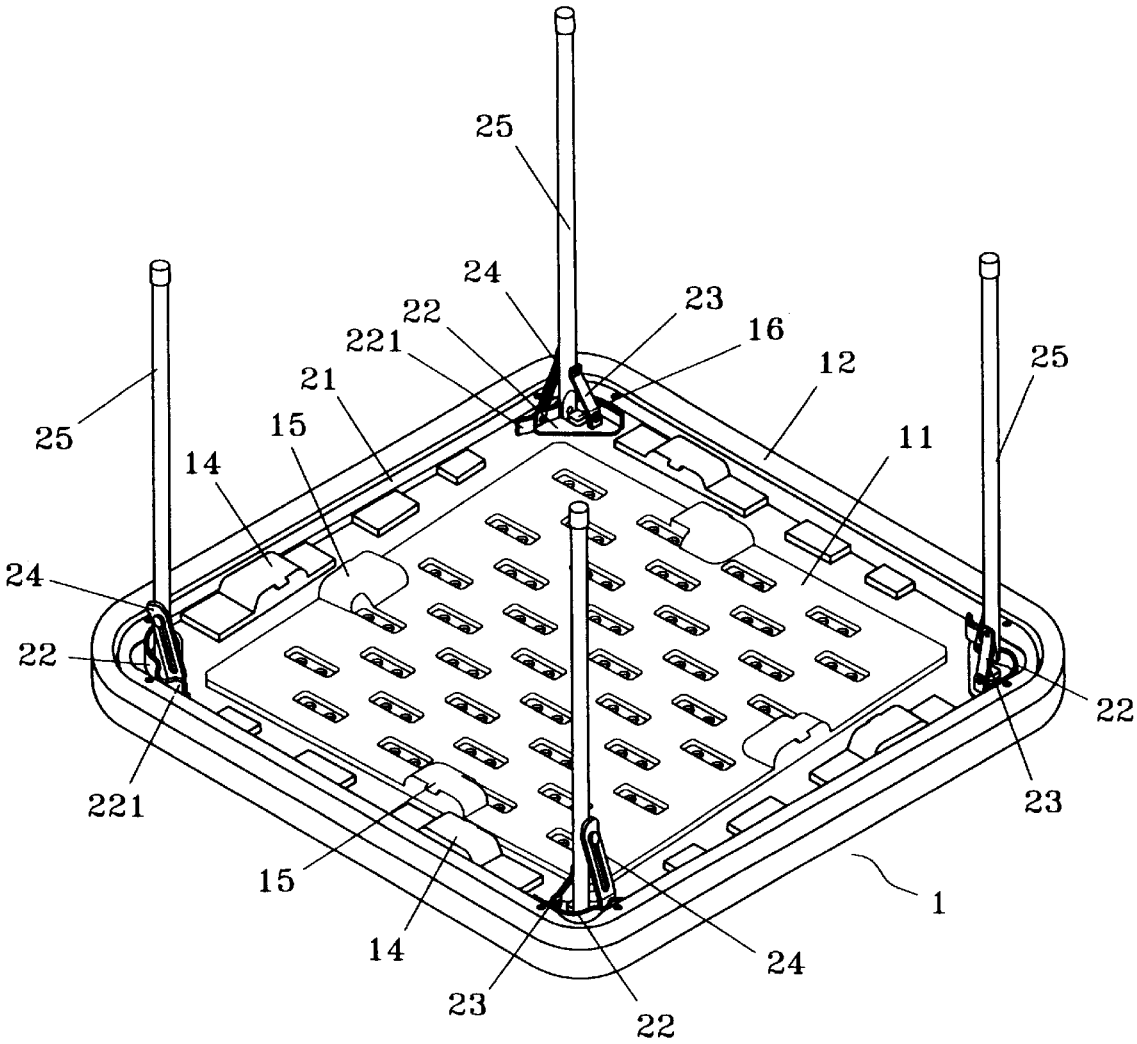
FIG. 5 is a schematic view illustrating four leg tubes of a preferred embodiment are extended.
Figure 6:
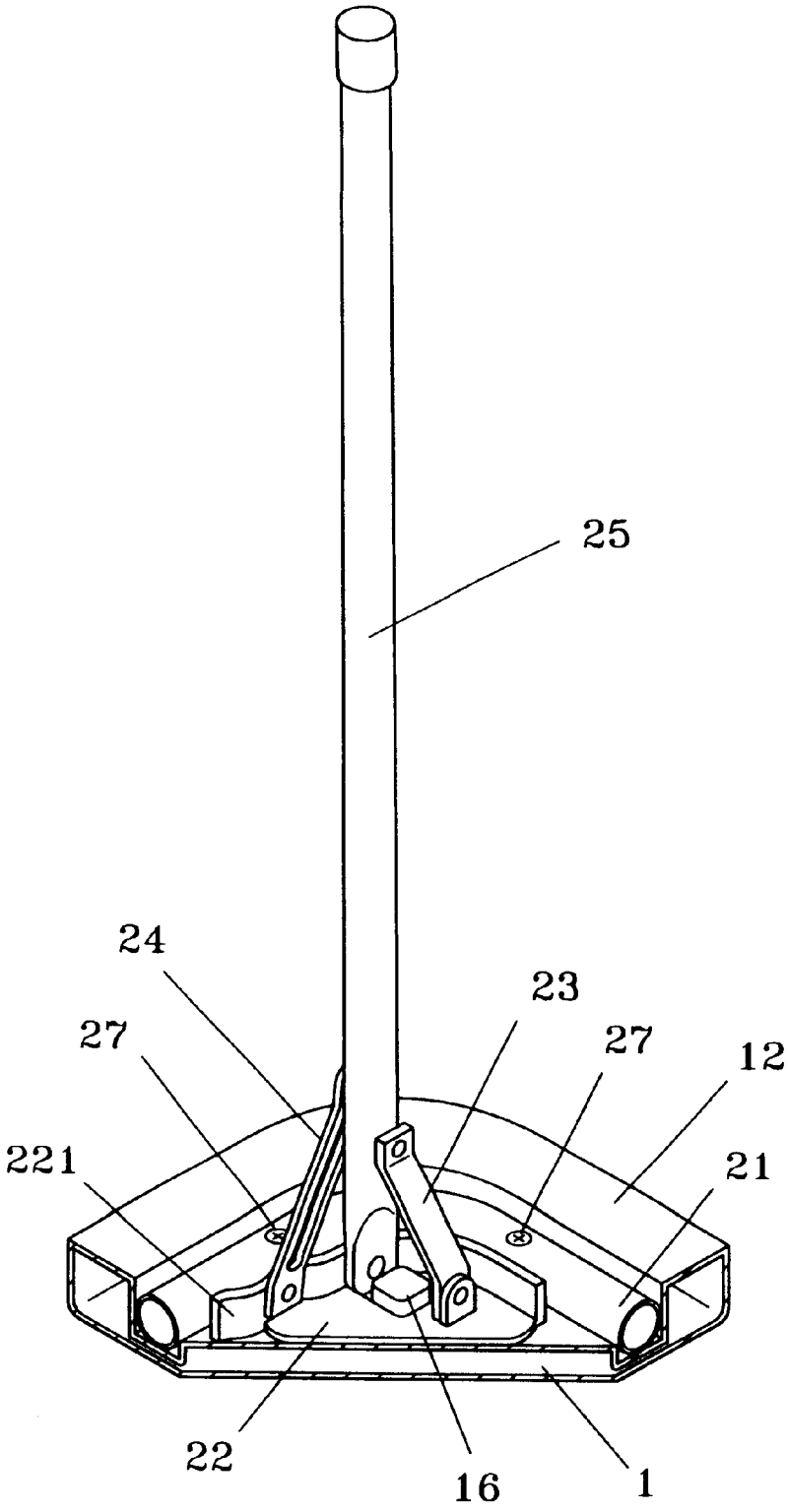
FIG.6 is a partiall sectional schematic view illustrating a hoop-shaped frame engaging with a plastics table plate of a preferred embodiment.
Figure 7:
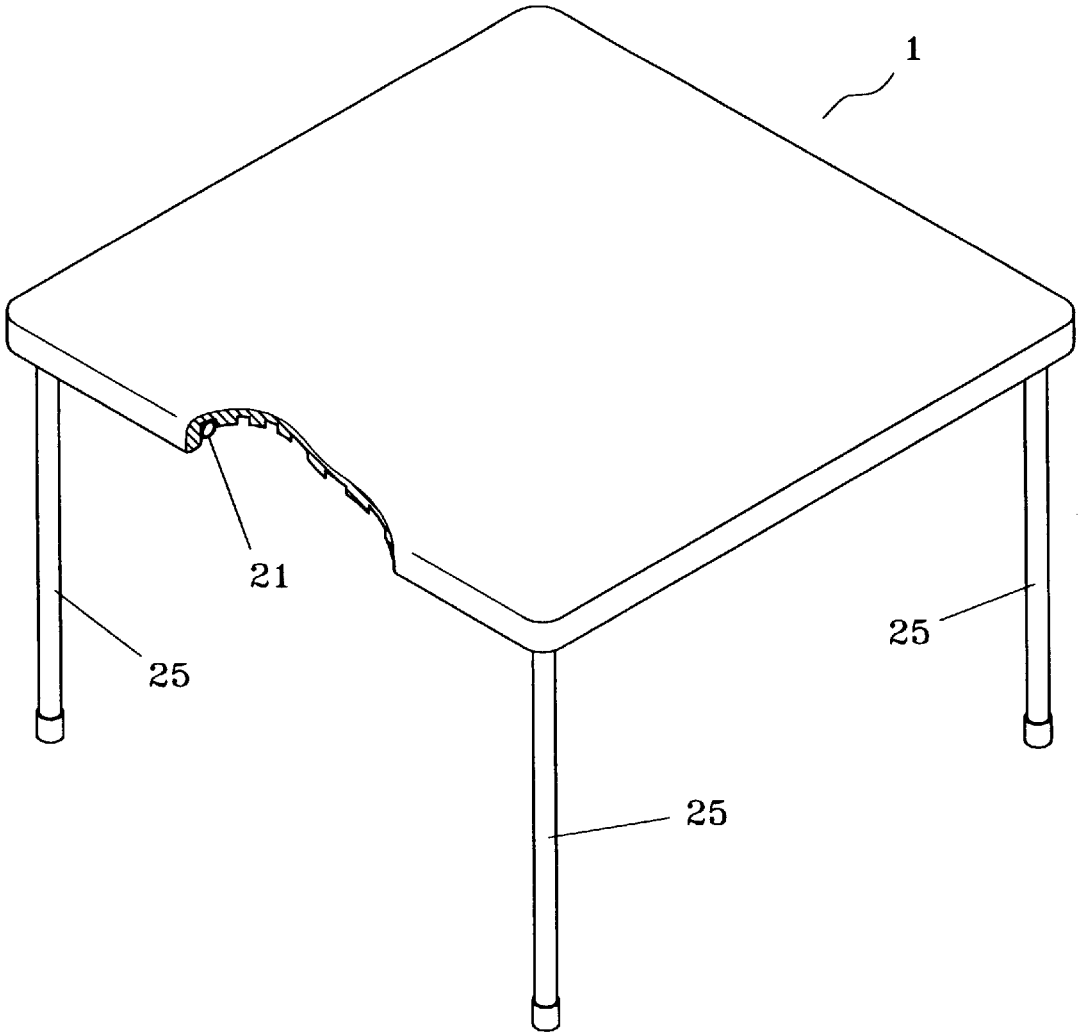
FIG. 7 is another schematic view illustrating four leg tubes of a preferred embodiment are extended.

Referring to FIGS. 1 to 7, a foldable table comprises a plastics table plate 1, a hoop-shaped frame 21, four corner seats 22 disposed on four corners of the hoop-shaped frame 21, four leg tubes 25, and a plurality of fastening members 27. Each of the leg tubes 25 is disposed on the corresponding corner seat 22.

A center panel 11 is disposed on the plastics table plate 1.

The plastics table plate 1 has a periphery flange 12 and a periphery channel 10.

Four protrusions 15 are disposed on the center panel 11.

Four protruded blocks 14 are disposed on the plastics table plate 1.

Four square blocks 16 are disposed on four corners of the plastics table plate 1.

A plurality of nuts 13 are implanted in the periphery channel 10 of the plastics table plate 1.

The hoop-shaped frame 21 has a plurality of through holes 211.

Each of the corner seats 22 has a groove 26 and an elastic blocking angle bar 221.

At least a connection bar 23 is connected to the corresponding corner seats 22 and the corresponding leg tube 25 pivotally.

At least a connection plate 24 is connected to the corresponding elastic blocking angle bar 221 and the corresponding leg tube 25 pivotally.

The hoop-shaped frame 21 is inserted in the plastics table plate 1 and confined by the periphery flange 12 of the plastics table plate 1.

Each of the square blocks 16 is inserted in the corresponding groove 26 of the corner seat 22.

Each of the fastening members 27 passes through the corresponding through hole 211 of the hoop-shaped frame 21 and the corresponding nut 13.

The plastics table plate 1 is made by a blow molding method.

Referring to FIGS. 5 and 7 again, the leg tubes 25 are extended.

Referring to FIG. 3 again, the leg tubes 25 are folded.

Each of the leg tubes 25 is confined by the corresponding protrusion 15 and the corresponding protruded block 14.

The invention has the following advantages. The plastics table plate is made by a blow molding method in order to reduce a weight of the plastics table plate. The nuts are implanted in the periphery channel of the plastics table plate in advance, so it is easy to assemble the foldable table. The corner seats reinforce a strength of the plastics table plate. The connection bar and the connection plate stabilize the corresponding leg tube. The plastics table plate receives the leg tubes so that the foldable table will be in a compact configuration while the leg tubes are folded.

The invention is not limited to the above embodiment but various modification thereof may be made. Further, various changes in form and detail may be made without departing from the scope of the invention.

I claim:

1. A foldable table comprises:

a plastics table plate, a hoop-shaped frame, four corner seats disposed on four corners of the hoop-shaped frame, four leg tubes, and a plurality of fastening members, each of the leg tubes disposed on the corresponding corner seat, a center panel disposed on the plastics table plate, the plastics table plate having a periphery flange and a periphery channel, four protrusions disposed on the center panel, four protruded blocks disposed on the plastics table plate, four square blocks disposed on four corners of the plastics table plate, a plurality of nuts implanted in the periphery channel of the plastics table plate, the hoop-shaped frame having a plurality of through holes, each of the corner seats having a groove and an elastic blocking angle bar, at least a connection bar connected to the corresponding corner seat and the corresponding leg tube pivotally, at least a connection plate connected to the corresponding elastic blocking angle bar and the corresponding leg tube pivotally, the hoop-shaped frame inserted in the plastics table plate and confined by the periphery flange of the plastics table plate, and each of the square blocks inserted in the corresponding groove of the corner seat.

* * * * *